US008016602B2

(12) United States Patent
Wadoux

(10) Patent No.: US 8,016,602 B2
(45) Date of Patent: Sep. 13, 2011

(54) MULTICONTACT CONNECTOR WITH AN INCORPORATED ROTARY LOCKING PART

(75) Inventor: Pierre Wadoux, Mettray (FR)

(73) Assignee: Radiall, Rosny-Sous-Bois (FR)

( * ) Notice: Subject to any disclaimer, the term of this patent is extended or adjusted under 35 U.S.C. 154(b) by 151 days.

(21) Appl. No.: 12/463,829

(22) Filed: May 11, 2009

(65) Prior Publication Data

US 2009/0286425 A1 Nov. 19, 2009

(30) Foreign Application Priority Data

May 15, 2008 (FR) ..... 08 53144

(51) Int. Cl.
*H01R 13/62* (2006.01)

(52) U.S. Cl. ..... 439/157; 439/372

(58) Field of Classification Search ..... 439/157, 439/159, 372

See application file for complete search history.

(56) References Cited

U.S. PATENT DOCUMENTS

| | | | | |
|---|---|---|---|---|
| 2,987,693 | A | 6/1961 | Wamsley | |
| 5,174,785 | A | 12/1992 | Endo et al. | |
| 5,603,624 | A | 2/1997 | Taguchi et al. | |
| 5,647,752 | A | 7/1997 | Taguchi | |
| 6,439,902 | B1 * | 8/2002 | Cole et al. | 439/157 |
| 6,623,287 | B2 * | 9/2003 | Hatagishi et al. | 439/157 |
| 2003/0109167 | A1 | 6/2003 | Maegawa | |

FOREIGN PATENT DOCUMENTS

FR 2 884 059 A1 10/2006

* cited by examiner

*Primary Examiner* — Xuong Chung Trans
(74) *Attorney, Agent, or Firm* — Oliff & Berridge, PLC

(57) ABSTRACT

A connection assembly includes a first multicontact connector housing having at least one blocking element in relief; and a second multicontact connector housing having a housing body extending along a longitudinal axis and a locking cap that is movable relative to the housing body of the second housing between a locked position and an unlocked position. The locking cap pivots about an axis perpendicular to the longitudinal axis. The second housing includes at least one face that includes a locking zone for locking the locking cap. The locking cap includes at least one blocking ramp and at least one locking tab.

6 Claims, 2 Drawing Sheets

Fig.3
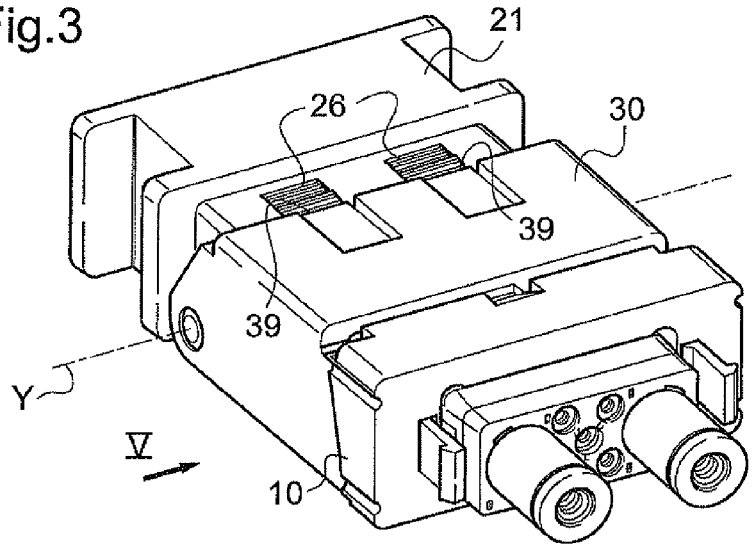
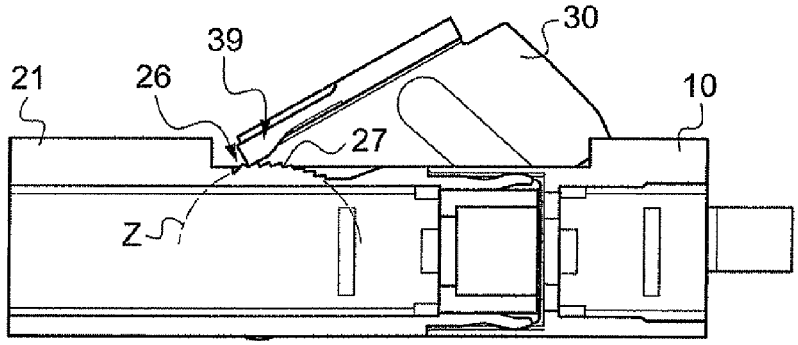
Fig.4
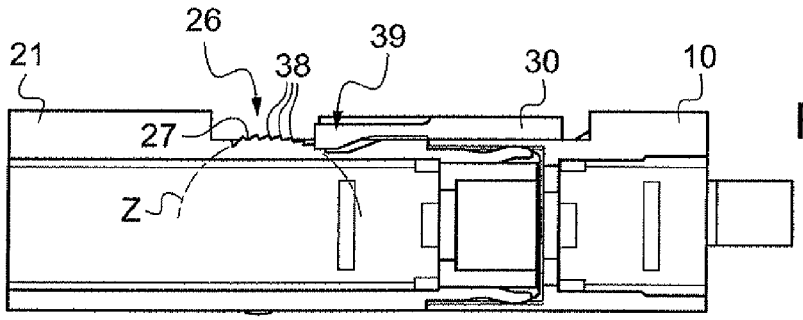
Fig.5

MULTICONTACT CONNECTOR WITH AN INCORPORATED ROTARY LOCKING PART

FIELD OF THE INVENTION

The present invention relates to a multicontact connector for use in particular in the field of equipment on board an aircraft.

BACKGROUND OF THE INVENTION

Document FR 2 884 059 in the name of the Applicant discloses a connection assembly comprising a first housing and a second housing suitable for being assembled with the first housing. The second housing has a housing body and a locking cap that is movable in translation relative to the housing body between an unlocked position and a locked position.

The use of such a connection assembly requires the locking part to be guided in translation, which part can become jammed or wedged in a connection assembly that is wider than it is tall.

OBJECT AND SUMMARY OF THE INVENTION

The invention seeks to solve the problem by providing good guidance and stiffening to the locking part, while maintaining an advantageous stroke.

The connection assembly of the invention comprises:

- a first multicontact connector housing having at least one blocking element in relief; and
- a second multicontact connector housing suitable for being assembled, preferably in releasable manner, with the first housing, the second housing having a housing body extending along a longitudinal axis and a locking cap that is movable relative to the housing body of the second housing between a locked position and an unlocked position, the locking cap including at least one locking ramp in which the blocking element in relief of the first housing can slide when the locking cap passes from the unlocked position towards the locked position, such that when the locking cap is in the locked position, co-operation between the blocking element in relief and the blocking ramp holds the two housings together in a direction parallel to the longitudinal axis, wherein the locking cap is movable in pivoting relative to the housing body of the second housing about an axis that is perpendicular to the longitudinal axis.

The term "locked position of the locking cap" designates the position of the locking cap when the two housings are held together in a direction relative to the longitudinal axis of the housing body of the second housing.

The locking ramp is advantageously defined by a rectilinear first longitudinal edge and by a second longitudinal edge including at least a portion that becomes spaced further apart from the first longitudinal edge on going away from the end of the ramp. Such a shape for the blocking ramp is adapted to movement of the locking cap in pivoting and enables the first and second housings to be fully coupled together before the locking cap closes.

The second longitudinal edge portion of the ramp that becomes spaced further from the first longitudinal edge advantageously presents a shape that is curved.

Advantageously, the locking cap is mounted to pivot on two pegs disposed respectively on two opposite side faces of the housing body of the second housing.

The term "side face of the housing body" when used with respect to the second housing or to the first housing designates a side face extending along the longitudinal axis of the housing body and different from the top and bottom faces of the housing body.

Connecting the locking cap and the housing body of the second housing together via two pegs serves to stiffen and guide the locking cap.

At least a face of the housing body of the second housing, e.g. its top face, advantageously includes at least one locking zone for locking the locking cap. By way of example, this locking zone extends along the longitudinal axis of the housing body of the second housing.

By way of example, the locking cap includes at least one locking tab projecting rearwards from the cap and configured to come into contact with the locking zone when the locking cap goes from the unlocked position towards the locked position.

The at least one locking tab may be configured to come into contact with the locking zone when the locking cap is in the locked position.

The locking zone advantageously includes at least one portion that presents a shape that is generally curved, advantageously having a profile that corresponds to the path followed by the locking cap on passing from the unlocked position towards the locked position.

The portion presenting a shape that is generally curved comprises advantageously, being in particular constituted by, a succession of teeth in alignment along a curved axis.

BRIEF DESCRIPTION OF THE DRAWINGS

Other characteristics and advantageous properties of the invention appear from the following description of non-limiting embodiments thereof and on examining the accompanying drawings, in which:

FIG. 3 is an overall view of the coupled connection when the locking cap is in the locked position; and FIGS. 4 and 5 are side views looking along arrows IV and V in FIGS. 2 and 3.

MORE DETAILED DESCRIPTION

Figure 1:
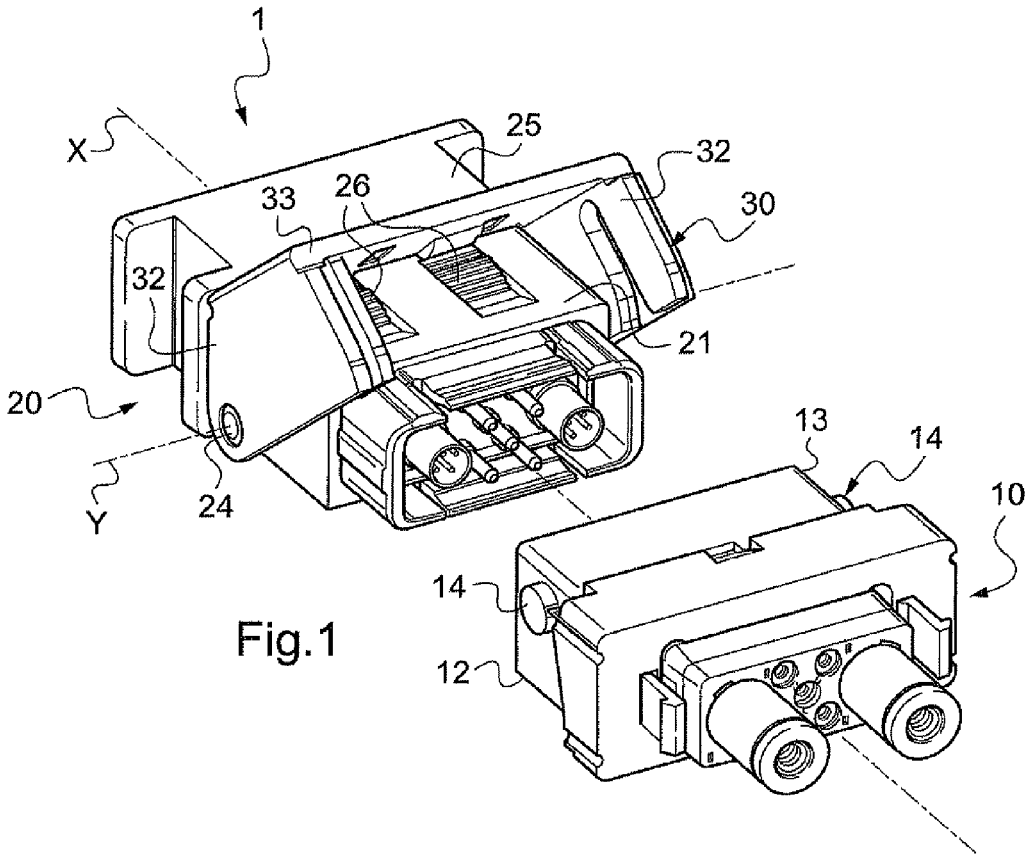
FIG. 1 is an exploded view of a connection assembly of the invention.

FIG. 1 shows a connection assembly given overall reference 1.

This connection assembly comprises a first multicontact connector housing given overall reference 10 and a second multicontact connector housing given overall reference 20.

The first housing 10 extends along a longitudinal axis X and presents on each side face 12 or 13 a blocking element in relief 14. By way of example, these blocking elements in relief 14 are studs.

Figure 2:
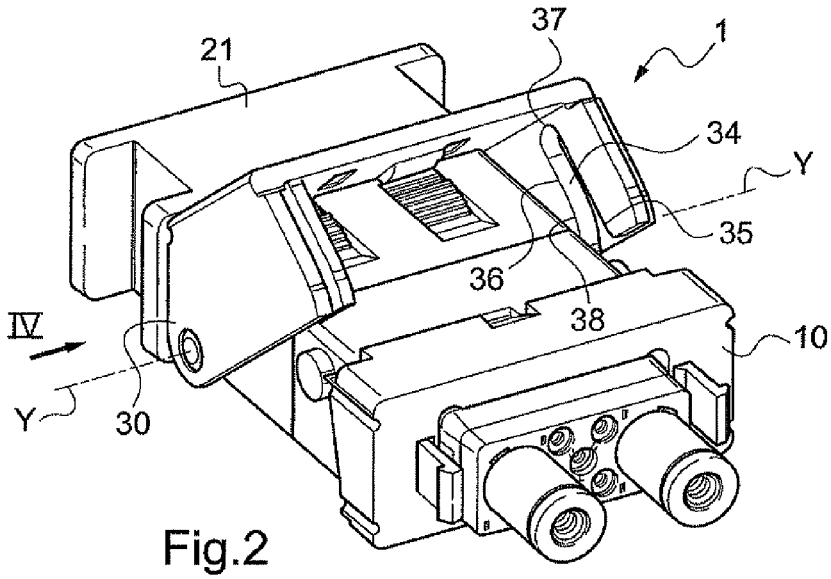
FIG. 2 is an overall view of a coupled connection when the locking cap is in the unlocked position.

The first housing 10 is configured to be coupled with the second housing 20, as shown in FIG. 2.

The second housing 20 comprises a housing body 21 and a locking cap 30 that is mounted to pivot relative to the housing body 21 of the second housing 20 about an axis Y that is perpendicular to the longitudinal axis X along which said housing body 21 extends. By way of example, the first housing 10 and the second housing 20 are made of a plastic material presenting a metal coating.

As can be seen in FIGS. 1 to 3, the locking cap 30 is mounted to pivot on two pegs 24 disposed respectively on two opposite side faces of the housing body 21 of the second housing 20.

The housing body 21 of the second housing 20 includes two locking zones 26, on its top face 25 in the example described, which zones extend, in the example described, along the longitudinal axis X of the housing body 21 of the second housing 20.

As can be seen in FIGS. 4 and 5, this locking zone 26 includes at least one portion 27 of generally curved shape. By way of example, this portion 27 comprises, or is constituted by, a succession of teeth 28 aligned along a curvilinear axis Z. This portion 27 of generally curved shape presents a radius of curvature lying in the range 8 millimeters (mm) to 16 mm, for example.

By way of example, the locking cap 30 presents a U-shaped section defined by two side faces 32 and a top face 33.

Each side face 32 includes, on its inside surface, a blocking ramp 34.

As can be seen in FIGS. 1 and 2, the blocking ramps 34 is defined by a first longitudinal edge 35 and a second longitudinal edge 36. On going away from the end 37 of the blocking ramp, the second longitudinal edge 36 is spaced further from the first longitudinal edge 35 via a diverging portion 38. By way of example, this diverging portion 38 is a curved portion presenting a radius of curvature lying in the range 3 mm to 8 mm.

The flared shape of the blocking ramp 34 enables each blocking element in relief 14 to slide in a blocking ramp 34 during pivoting movement of the locking cap going from the unlocked position to the locked position, after the first and second housings 10 and 20 have been coupled together fully, as shown in FIG. 2.

The locking cap 30 also has two locking tabs 39 extending the top face 33 and projecting towards the rear of the locking cap 30, as shown in FIGS. 3 to 5, for example.

As can be seen in FIGS. 4 and 5, when the locking cap 30 goes from the unlocked position as shown in FIG. 2 to the locked position as shown in FIG. 3, the locking tabs 39 of the cap move in rotation along the portion 27 that presents a generally curved shape in the locking zone 26, thereby enabling the movement of the locking cap 30 to be accompanied by the locking zone 26 of the housing body 21 of the second housing 20.

In the locked position, the locking tabs 39 may bear against the teeth 28 of the locking zone 26, as shown in FIG. 5.

In the claims, the term "comprising a" should be understood as meaning "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A connection assembly comprising:

a first multicontact connector housing having at least one blocking element in relief; and a second multicontact connector housing suitable for being assembled with the first housing, the second housing having a housing body extending along a longitudinal axis and a locking cap that is movable relative to the housing body of the second housing between a locked position and an unlocked position, the locking cap being movable relative to the housing body of the second housing in pivoting about an axis perpendicular to the longitudinal axis, the housing body of the second housing have at least one face that includes at least one locking zone extending along the longitudinal axis of the housing body of the second housing, for locking the locking cap, the locking cap having at least one blocking ramp in which the blocking element in relief of the first housing can slide when the locking cap passes from the unlocked position towards the locked position, in such a manner that when the locking cap is in the locked position, co-operation between the blocking element in relief and the blocking ramp holds the two housings together in a direction parallel to the longitudinal axis, wherein the locking cap includes at least one locking tab projecting rearwards from the cap and configured to come into contact with the locking zone when the locking cap passes from the unlocked position towards the locked position, and the locking zone includes at least one portion presenting a shape that is generally curved, and that is defined by a succession of teeth in alignment along a curved axis.

2. An assembly according to claim 1, wherein the blocking ramp is defined by a rectilinear first longitudinal edge and by a second longitudinal edge including at least a portion that becomes spaced further apart from the first longitudinal edge on going away from the end of the blocking ramp.

3. An assembly according to claim 2, wherein the portion of the second longitudinal edge of the blocking ramp that becomes spaced further apart from the first longitudinal edge presents a curved shape.

4. An assembly according to claim 1, wherein the locking cap is mounted to pivot on two pegs disposed respectively on two opposite side faces of the housing body of the second housing.

5. An assembly according to claim 1, wherein the locking zone(s) of the locking cap are arranged on the top face of the housing body of the second housing.

6. An assembly according to claim 1, wherein the at least one locking tab is configured to come into contact with the locking zone when the locking cap is in the locked position.

* * * * *